US008037937B2

(12) United States Patent
Freyer

(10) Patent No.: US 8,037,937 B2
(45) Date of Patent: Oct. 18, 2011

(54) METHOD AND A DEVICE FOR SOLVENT INJECTION IN A SUBSURFACE WELL

(76) Inventor: Rune Freyer, Stavanger (NO)

( * ) Notice: Subject to any disclaimer, the term of this patent is extended or adjusted under 35 U.S.C. 154(b) by 578 days.

(21) Appl. No.: 11/719,174

(22) PCT Filed: Nov. 14, 2005

(86) PCT No.: PCT/NO2005/000426

§ 371 (c)(1),
(2), (4) Date: Jan. 16, 2009

(87) PCT Pub. No.: WO2006/054901

PCT Pub. Date: May 26, 2006

(65) Prior Publication Data

US 2009/0223669 A1 Sep. 10, 2009

(30) Foreign Application Priority Data

Nov. 17, 2004 (NO) ..... 20044988

(51) Int. Cl.
*E21B 43/16* (2006.01)

(52) U.S. Cl. ..... 166/305.1; 166/90.1; 166/279

(58) Field of Classification Search ..... None
See application file for complete search history.

(56) References Cited

U.S. PATENT DOCUMENTS

| | | | | |
|---|---|---|---|---|
| 4,192,555 | A | 3/1980 | Willett | |
| 5,167,280 | A | 12/1992 | Sanchez et al. | |
| 5,363,915 | A | 11/1994 | Marquis et al. | |
| 6,318,468 | B1 * | 11/2001 | Zakiewicz | 166/305.1 |
| 6,755,249 | B2 | 6/2004 | Robison et al. | |
| 2003/0234106 | A1 | 12/2003 | Surjaatmadja | |

FOREIGN PATENT DOCUMENTS

| | | | |
|---|---|---|---|
| EP | 1184537 | A2 | 3/2002 |
| NO | 20034790 | A | 4/2004 |

OTHER PUBLICATIONS

International Search Report for parent application PCT/NO2005/000426, having a mailing date of Mar. 10, 2006.

* cited by examiner

*Primary Examiner* — Zakiya Bates
(74) *Attorney, Agent, or Firm* — Andrus, Sceales, Starke & Sawall, LLP

(57) ABSTRACT

A method and a device for solvent injection in a subsurface well (1) where the solvent flows towards the formation wall (4) of the subsurface well (19) via a releasable duct (8).

11 Claims, 3 Drawing Sheets

I-I

METHOD AND A DEVICE FOR SOLVENT INJECTION IN A SUBSURFACE WELL

CROSS REFERENCE TO RELATED APPLICATIONS

This application is the U.S. national stage application of International Application PCT/NO2005/000426, filed Nov. 14, 2005, which International Application was published on May 26, 2006, as International Publication No. WO 2006/054901A1in the English language. The International Application claims priority of Norwegian Patent Application 20044988, filed Nov. 17, 2004.

BACKGROUND

This invention regards a method of injecting solvent in a subsurface well. More particularly, it regards a method in which the solvent is directed towards the formation wall of the subsurface well by means of a releasable duct. The invention also regards a device for implementing the method.

It is common, in order to stimulate the production from a subsurface well, to inject a solvent in the well. If the well formation comprises a carbonate material, acid is often used as solvent, e.g. hydrochloric acid, HCl, at an appropriate concentration.

It is known to pump the solvent into a casing and out into the well formation via perforations in the casing. Thus Norwegian patent application no. 20034790 describes a method in which the solvent is pumped out through said perforations at a sufficient concentration and in sufficient quantity to cause the surrounding formation to collapse to a certain extent.

The drawback of prior art is that it is difficult to direct the solvent to the area of the well formation that requires treatment. The solvent may for instance follow natural fractures to areas where the introduction of these types of chemicals is not desirable. Uncontrolled inflow of the solvent may dissolve the formation around the well without effecting the formation of fractures that are deep enough to create flow paths to the reservoir.

This type of incorrect treatment of the well formation may cause e.g. a significant increase in water production from the subsurface well.

SUMMARY

The object of the invention is to remedy or reduce at least one of the disadvantages of prior art.

The object is achieved in accordance with the invention, by the characteristics stated in the description below and in the following claims.

Performing the solvent injection in a subsurface well via a releasable duct allows the solvent injection to be directed at the well formation wall in a more accurate and controllable manner than what is known from prior art.

The solvent flows via a supply pipe from the surface and down to the releasable duct, one end portion of which communicating with the supply pipe. Advantageously the supply pipe is a well completion pipe.

The outlet of the releasable duct is brought to aim at the formation wall after the releasable duct has been released.

Advantageously the releasable duct is released by the solvent. As an example, a locking body of a locking device may be weakened by the solvent and thereby release the releasable duct.

Alternatively the releasable duct may be released by an actuator.

Following release the releasable duct may direct itself at the formation wall with the aid of e.g. biasing forces, gravity or an actuator.

In one embodiment the releasable duct may be provided with perforations along its longitudinal extent to ensure that the solvent does not exit from one end of the duct only.

It may also be desirable to leave at least one duct freely suspended along the supply pipe.

The solvent to be used is matched to the formation material of the subsurface well in a manner that is known per se, and if the formation in question is a carbonate formation, it may consist of an acid, typically hydrochloric acid.

Compared with prior art, where the solvent flows into the formation through perforations provided to ensure the best possible outflow from the subsurface well, injection of a solvent by the method and device of the invention will increase the contact area significantly and ensure improved directional control of the injected solvents.

BRIEF DESCRIPTION OF THE DRAWINGS

The following describes a non-limiting example of a preferred method and embodiment illustrated in the accompanying drawings, in which.

DETAILED DESCRIPTION OF THE DRAWINGS

Figure 1:
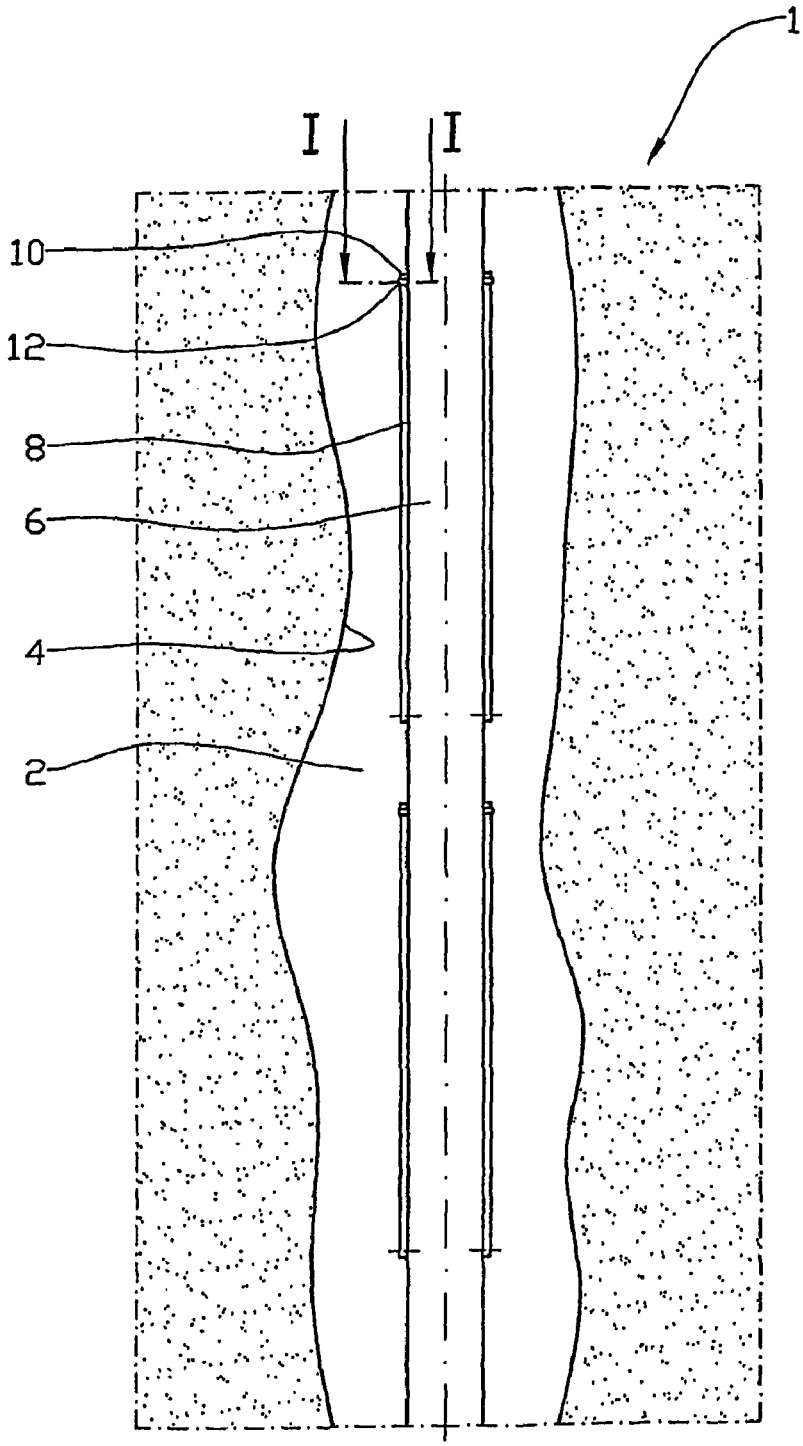
FIG. 1 shows a vertical section of a subsurface well in which there is provided a supply pipe having releasable ducts for injection of solvent.

In the drawings, reference number 1 denotes a subsurface well comprising a wellbore 2 and a formation wall 4. A supply pipe 6 in the form of a well completion pipe is arranged in the subsurface well 1.

The supply pipe 6 is provided with a plurality of external tubular releasable ducts 8 running along the supply pipe 6. One end portion of each releasable duct 8 communicates with the supply pipe 6, while the opposite end portion 10 is connected to the supply pipe 6 by means of a releasable locking device 12, see FIG. 3.

Figure 2:
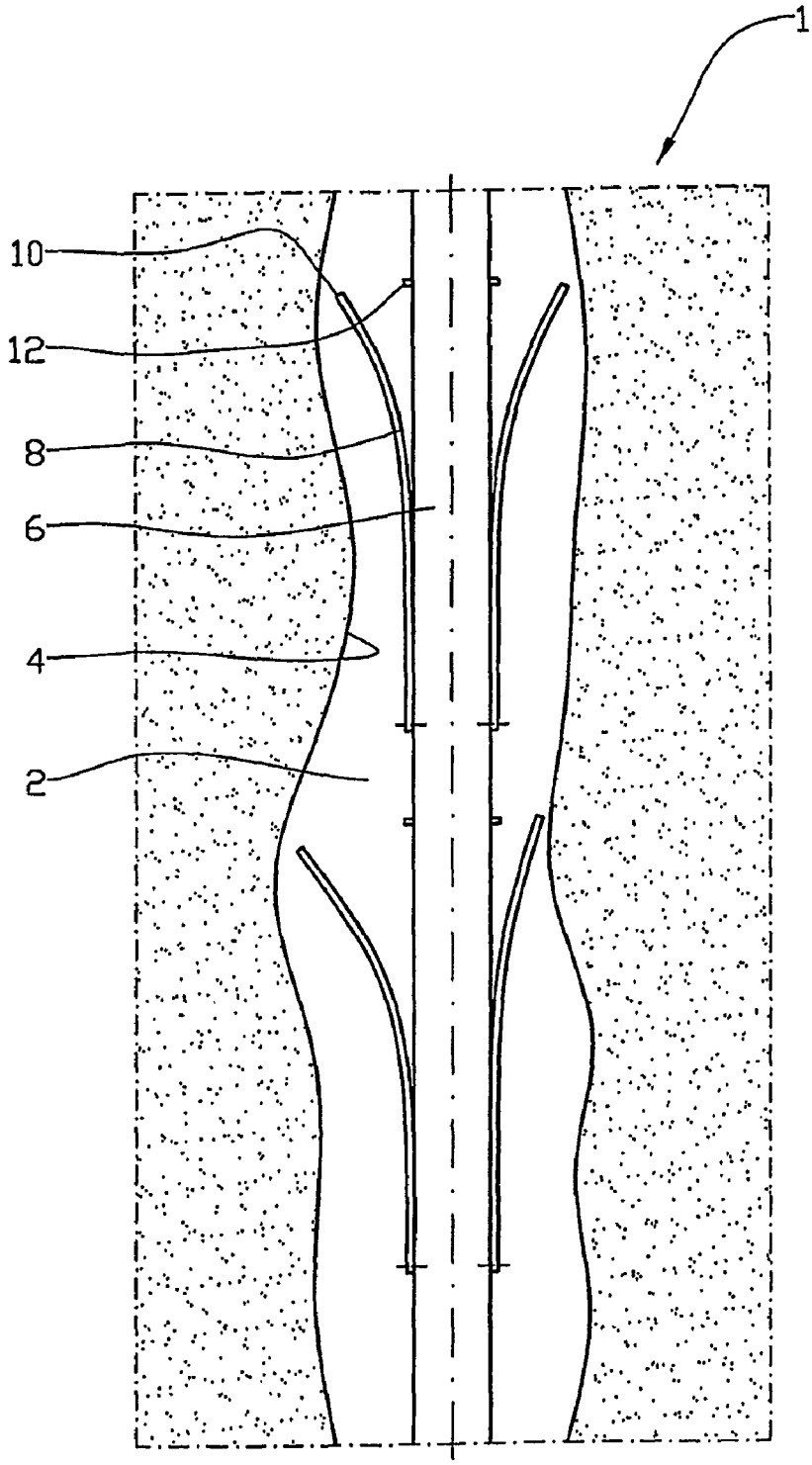
FIG. 2 shows the same as FIG. 1, but with the releasable ducts released and directed at the formation wall of the subsurface well.

The releasable ducts 8 are biased in a manner such that upon being released, they attempt to point themselves at the formation wall 4, see FIG. 2. The releasable ducts 8 may be provided with perforations (not shown).

Figure 3:
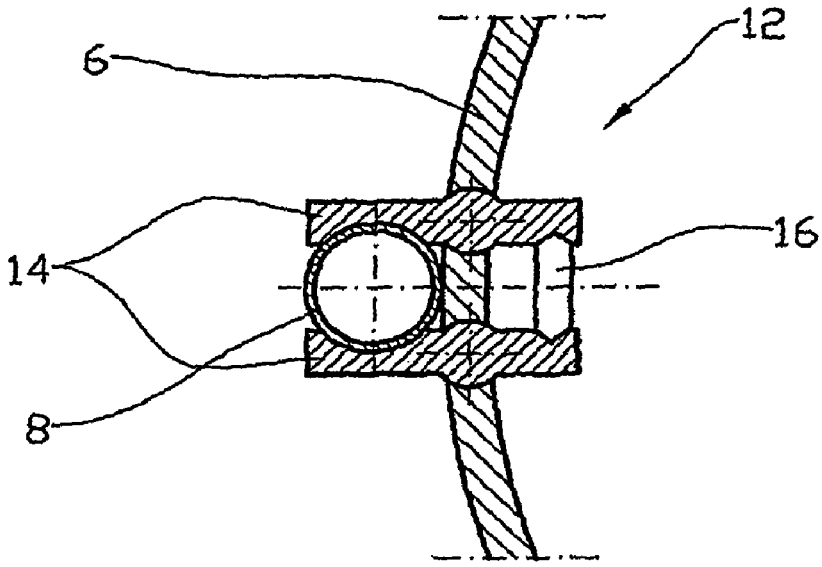
FIG. 3 is a schematic sectional view along I-I in FIG. 1, on a larger scale.

The releasable locking device 12 comprises two locking arms 14 sealingly and rotatably supported in the supply pipe 6, see FIG. 3. The locking arms 14 are kept in engagement around the releasable duct 8 by means of a soluble locking body 16.

Figure 4:
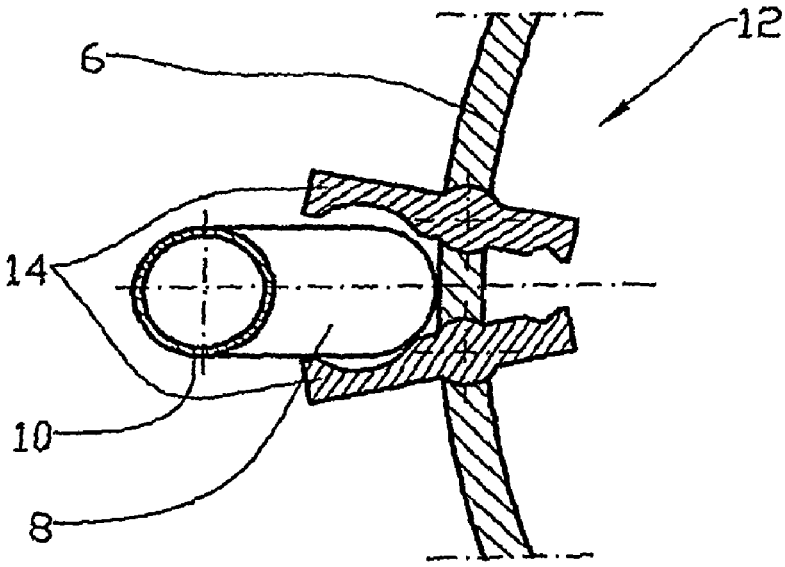
FIG. 4 shows the same as FIG. 3, but with the releasable duct released.

When the locking body 16 is dissolved by acid and collapses, the locking arms 14 may rotate out of the engagement with the releasable duct 8, see FIG. 4, the releasable duct 8 turning its open end portion 10 towards the formation wall 4 as shown in FIG. 2, owing to its bias.

The invention claimed is:

1. A method of injecting solvents in a subsurface well, the method comprising:

delivering solvent to the subsurface well via a well completion pipe such that the solvent flows towards the formation wall of the subsurface well via a releasable elongated tubular duct that is external to the well completion pipe and that communicates through the wall of the well completion pipe.

2. A method in accordance with claim 1, comprising bringing the open end portion of the releasable duct to aim at the formation wall after the releasable duct has been released.

3. A method in accordance with claim 1, comprising releasing the releasable duct by means of the solvent.

4. A method in accordance with claim 1, comprising releasing the releasable duct by means of an actuator.

5. A device for solvent injection in a subsurface well, the device comprising: a well completion pipe, wherein the solvent flows into the subsurface well via a well completion pipe, wherein the well completion pipe communicates with at least one releasable elongated duct located external to the well completion pipe and in the subsurface well, and wherein the releasable elongated duct communicates through a wall of the well completion pipe.

6. A device in accordance with claim 5, wherein the releasable duct is connected to the well completion pipe by a releasable locking device.

7. A device in accordance with claim 6, wherein the releasable locking device comprises a soluble body.

8. A device in accordance with claim 5, wherein the releasable duct has been biased.

9. A device in accordance with claim 5, wherein the solvent is an acid.

10. A method of injecting solvents in a subsurface well, the method comprising delivering solvent to the subsurface well via a well completion pipe, such that the solvent flows towards the formation wall of the subsurface well via a releasable elongated tubular duct that communicates with the well completion pipe, wherein the releasable duct is released by means of the solvent.

11. A device for solvent injection in a subsurface well, the device comprising: a well completion pipe, wherein the solvent flows into the subsurface well via a well completion pipe, wherein the well completion pipe communicates with at least one releasable elongated duct located in the subsurface well, wherein the releasable duct is connect to the well completion pipe by a releasable locking device, and wherein the releasable locking device comprises a soluble body.

* * * * *